US010090126B2

(12) United States Patent
Kakio et al.

(10) Patent No.: US 10,090,126 B2
(45) Date of Patent: Oct. 2, 2018

(54) OPENING AND CLOSING DEVICE

(71) Applicant: Mitsubishi Electric Corporation, Chiyoda-ku (JP)

(72) Inventors: Masayuki Kakio, Chiyoda-ku (JP); Munetaka Kashiwa, Chiyoda-ku (JP); Shintaro Yamada, Chiyoda-ku (JP); Toshihiro Matsunaga, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/100,684

(22) PCT Filed: Sep. 11, 2014

(86) PCT No.: PCT/JP2014/074073

§ 371 (c)(1),
(2) Date: Jun. 1, 2016

(87) PCT Pub. No.: WO2015/098200

PCT Pub. Date: Jul. 2, 2015

(65) Prior Publication Data

US 2016/0300678 A1 Oct. 13, 2016

(30) Foreign Application Priority Data

Dec. 26, 2013 (JP) ..... 2013-268771

(51) Int. Cl.
*H01H 50/30* (2006.01)
*H01H 33/42* (2006.01)
(Continued)

(52) U.S. Cl.
CPC ..... *H01H 50/305* (2013.01); *H01H 1/50* (2013.01); *H01H 3/60* (2013.01); *H01H 33/38* (2013.01);
(Continued)

(58) Field of Classification Search
CPC ..... H01H 33/38; H01H 33/42; H01H 33/666; H01H 50/305; H01H 50/641; H01H 50/22; H01H 2235/01
See application file for complete search history.

(56) References Cited

U.S. PATENT DOCUMENTS 4,027,125 A 5/1977 Peek et al.
2004/0154791 A1* 8/2004 Adoline ..... E21B 43/127 166/105
(Continued)

FOREIGN PATENT DOCUMENTS

CN 2343664 Y 10/1999
CN 1637978 A 7/2005
(Continued)

OTHER PUBLICATIONS

International Search Report dated Nov. 4, 2014 in PCT/JP2014/074073, filed on Sep. 11, 2014.
(Continued)

*Primary Examiner* — Bernard Rojas
(74) *Attorney, Agent, or Firm* — Oblon, McClelland, Maier & Neustadt, L.L.P.

(57) ABSTRACT

A switchgear includes a stationary contact, a movable contact able to be shifted between a closed position and an opened position, an electromagnetic actuator able to generate power for shifting the movable contact, the electromagnetic actuator including a stator and a movable element, and a power transmission unit able to shift the movable contact, and to press the movable contact against the stationary contact. The power transmission unit includes a drive unit-side spring bearing portion able to be shifted together with the movable element, a contact-side spring bearing portion to be opposed to the drive unit-side spring bearing portion, and able to be shifted together with the movable contact, and a spring member provided between the drive unit-side spring bearing portion and the contact-side spring bearing portion.

7 Claims, 7 Drawing Sheets

(51) Int. Cl.

| | |
|---|---|
| ***H01H 33/666*** | (2006.01) |
| ***H01H 33/38*** | (2006.01) |
| ***H01H 50/22*** | (2006.01) |
| ***H01H 50/64*** | (2006.01) |
| ***H01H 1/50*** | (2006.01) |
| ***H01H 3/60*** | (2006.01) |

(52) U.S. Cl.
CPC ..... *H01H 33/42* (2013.01); *H01H 33/666* (2013.01); *H01H 50/22* (2013.01); *H01H 50/641* (2013.01); *H01H 2235/01* (2013.01)

(56) References Cited

U.S. PATENT DOCUMENTS

| | | | |
|---|---|---|---|
| 2004/0238494 | A1 | 12/2004 | Einschenk et al. |
| 2007/0273461 | A1 | 11/2007 | Kang et al. |
| 2010/0078302 | A1 | 4/2010 | Erk et al. |

FOREIGN PATENT DOCUMENTS

| | | | |
|---|---|---|---|
| JP | 58-157016 | A | 9/1983 |
| JP | 6-32857 | U | 4/1994 |
| JP | 10-328481 | A | 12/1998 |
| JP | 11-48883 | A | 2/1999 |
| JP | 2006-164654 | A | 6/2006 |
| JP | 2007-523475 | A | 8/2007 |
| JP | 2008-166392 | A | 7/2008 |
| JP | 2009-266511 | A | 11/2009 |
| KR | 10-1090503 | | 12/2011 |
| WO | WO 2013/042566 | A1 | 3/2013 |

OTHER PUBLICATIONS

Office Action dated Jul. 19, 2017 in Korean Patent Application No. 10-2016-7017043 (with English translation).
Extended European Search Report dated Jul. 3, 2017 in Patent Application No. 14875418.7.
Chinese Office Action dated Jan. 12, 2018 in Chinese Patent Application No. 201480070813.6 w/English translation.

* cited by examiner

OPENING AND CLOSING DEVICE

TECHNICAL FIELD

The present invention relates to a switchgear to be used for power receiving and transforming facilities.

BACKGROUND ART

In electric power switchgears, bounce generally occurs between a pair of contacts when the contacts in an opened state are switched on (closed) at a given speed. The bounce is generally called chattering. The contacts have a potential difference therebetween, and hence an electric arc is generated between the contacts due to the chattering. As a result, the surface of the contact is roughen or worn out, thereby causing increase in contact resistance between the contacts. Further, when the contacts are separated from each other for a long period of time during the chattering, the contacts may be fused. In order to address those problems, it is important to suppress the chattering.

In general, the switch-on action is a collision event. Therefore, in order to suppress the bounce, it is effective to use a mechanism having a high damping effect, such as a rubber, thereby dissipating energy. Under a severe outdoor environment where the switchgear is used, however, deterioration of this mechanism becomes a problem, and hence this mechanism cannot be used.

In view of the above, hitherto, there is known a switchgear in which a stationary contact is supported on a support base through intermediation of laminated plates, which are a plurality of plates laminated on each other, thereby dissipating energy (see, for example, Patent Literature 1).

CITATION LIST

Patent Literature

[PTL 1] JP 2006-164654 A

SUMMARY OF INVENTION

Technical Problem

However, the laminated plates are required to have higher rigidity so as to retain the contact. As a result, there is a problem in that the effect of suppressing the chattering is degraded due to the increase in rigidity of the laminated plates.

The present invention provides a switchgear capable of suppressing chattering more greatly.

Solution to Problem

According to one embodiment of the present invention, there is provided a switchgear, including: a stationary contact; a movable contact, which is configured to be shifted between a closed position where the movable contact is brought into contact with the stationary contact and an opened position where the movable contact is separated from the stationary contact; a drive unit, which is configured to generate power for shifting the movable contact, the drive unit including: a stator; and a movable element, which is configured to be shifted relative to the stator; and a power transmission unit, which is configured to shift the movable contact through transmission of the power generated by the drive unit, and to press the movable contact against the stationary contact when the movable contact is located at the closed position, the power transmission unit including: a drive unit-side spring bearing portion, which is configured to be shifted together with the movable element; a contact-side spring bearing portion, which is provided so as to be opposed to the drive unit-side spring bearing portion, and is configured to be shifted together with the movable contact; and a spring member, which is provided between the drive unit-side spring bearing portion and the contact-side spring bearing portion, and is configured to push the drive unit-side spring bearing portion and the contact-side spring bearing portion in directions in which the drive unit-side spring bearing portion and the contact-side spring bearing portion are separated from each other, the spring member including: an outer spring, which is formed to have two or more nested coils; and an inner spring, which is provided on an inner side of the outer spring, connected in parallel to the outer spring, and is arranged so as to be contracted by the same amount as the outer spring during a period in which the movable contact is shifted from a state of being located at the opened position to a state of being located at a terminal end of switch-on action.

Advantageous Effects of Invention

According to the switchgear of the one embodiment of the present invention, when the movable contact is shifted from the opened position to the closed position, the effect on the movable contact from the exciting force generated due to the impact is reduced, thereby being capable of suppressing separation of the movable contact and the stationary contact. As a result, the chattering can be suppressed more greatly.

DESCRIPTION OF EMBODIMENTS

First Embodiment

Figure 1:
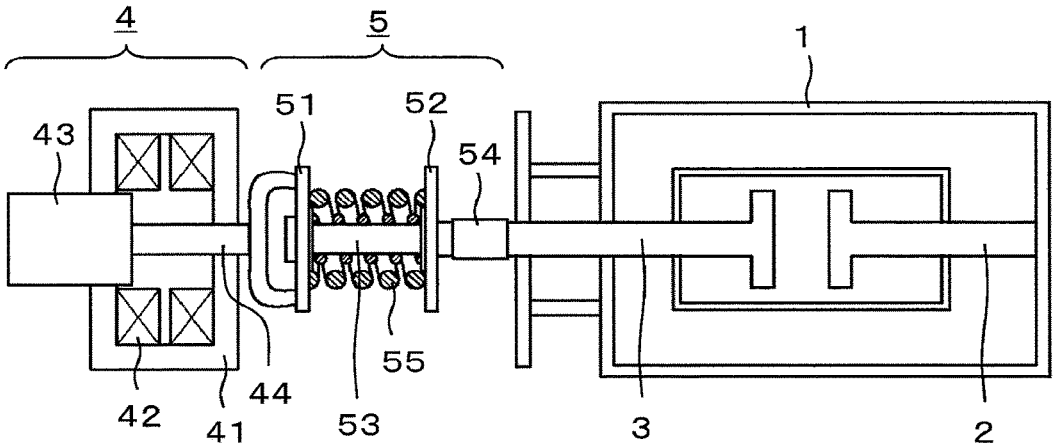
FIG. 1 is a sectional side view for illustrating a switchgear according to a first embodiment of the present invention.

FIG. 1 is a sectional side view for illustrating a switchgear according to a first embodiment of the present invention. FIG. 1 is an illustration of a state in which the switchgear is opened. In FIG. 1, the switchgear includes a housing 1 made of a resin, a stationary contact 2 received in the housing 1 and fixed to the housing 1, a movable contact 3 configured to be shifted between a closed position where the movable contact 3 is brought into contact with the stationary contact 2 and an opened position where the movable contact 3 is separated from the stationary contact 2, an electromagnetic actuator (drive unit) 4 configured to generate power for shifting the movable contact 3, and a power transmission unit 5 configured to shift the movable contact 3 through transmission of the power generated by the electromagnetic actuator 4, and to press the movable contact 3 against the stationary contact 2 when the movable contact 3 is located at the closed position.

The electromagnetic actuator 4 includes a case 41, a coil 42 received in the case 41 and fixed to the case 41, a movable element 43 formed of a magnet and provided so as to be insertable through the coil 42, and an actuator drive shaft 44 fixed to the movable element 43. A stator is constructed of the case 41 and the coil 42. The movable element 43 is movable in an axial direction of the coil 42. The actuator drive shaft 44 is arranged so as to extend in the moving direction of the movable element 43. Further, the actuator drive shaft 44 is arranged so as to extend from the movable element 43 toward the movable contact 3.

The power transmission unit 5 includes a drive unit-side spring bearing portion 51, a contact-side spring bearing portion 52 provided on the movable contact 3 side of the drive unit-side spring bearing portion 51 so as to be opposed to the drive unit-side spring bearing portion 51, a center shaft 53 provided so as to bridge the drive unit-side spring bearing portion 51 and the contact-side spring bearing portion 52, an insulation rod 54 provided between the center shaft 53 and the movable contact 3, and a spring member 55 provided between the drive unit-side spring bearing portion 51 and the contact-side spring bearing portion 52 and configured to push the drive unit-side spring bearing portion 51 and the contact-side spring bearing portion 52 in directions in which the drive unit-side spring bearing portion 51 and the contact-side spring bearing portion 52 are separated from each other.

The drive unit-side spring bearing portion 51 is fixed to the actuator drive shaft 44. Thus, the drive unit-side spring bearing portion 51 is shifted together with the movable element 43.

The contact-side spring bearing portion 52 is fixed to the center shaft 53. Thus, the contact-side spring bearing portion 52 is shifted together with the center shaft 53.

The center shaft 53 is not fixed to the drive unit-side spring bearing portion 51. Thus, the drive unit-side spring bearing portion 51 is shiftable in the axial direction relative to the center shaft 53.

The center shaft 53, the insulation rod 54, and the movable contact 3 are fixed to each other. Thus, the drive unit-side spring bearing portion 51 is shifted together with the movable contact 3.

The electromagnetic actuator 4 is configured to generate power through interaction caused by an electromagnetic force generated between the coil 42 and the movable element 43. The power generated by the electromagnetic actuator 4 is transmitted through the actuator drive shaft 44 to the drive unit-side spring bearing portion 51, the spring member 55, the contact-side spring bearing portion 52, and the center shaft 53 in the stated order. Further, the power is transmitted through the insulation rod 54 to the movable contact 3. In this case, the drive unit-side spring bearing portion 51 and the center shaft 53 are not fixed to each other, but a force for pressing the movable contact 3 against the stationary contact 2 (pressing force) is transmitted from the drive unit-side spring bearing portion 51 to the movable contact 3 via the spring member 55.

When the switchgear is closed, a magnetic attraction force F1 generated by the electromagnetic actuator 4 is set larger than a repulsive force F2 generated by the spring member 55 (magnetic attraction force F1>repulsive force F2), thereby securing the contact between the stationary contact 2 and the movable contact 3 under a state in which a pressure is generated between the stationary contact 2 and the movable contact 3. That is, in this case, the movable contact 3 is pressed against the stationary contact 2.

Figure 2:
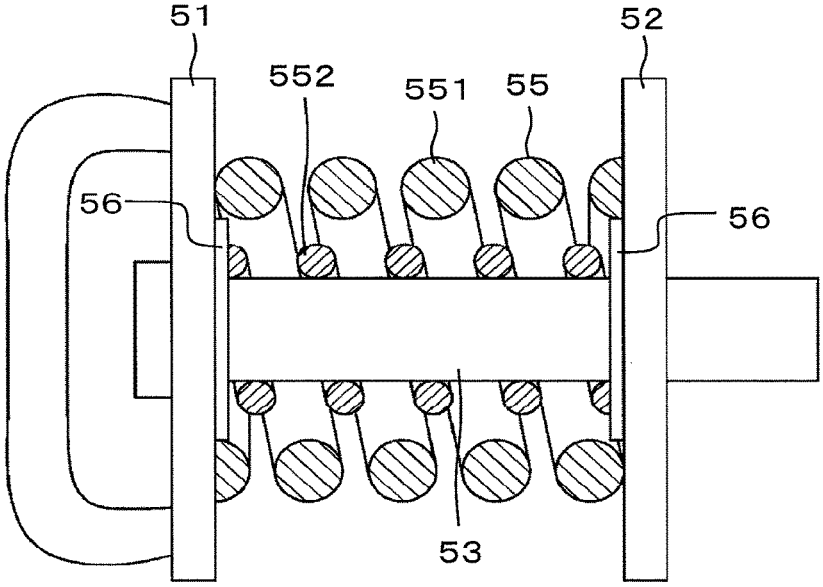
FIG. 2 is an enlarged view for illustrating a main part of a power transmission unit of FIG. 1.

FIG. 2 is an enlarged view for illustrating a main part of the power transmission unit 5 of FIG. 1. In FIG. 2, the spring member 55 includes an outer spring 551 extending along the center shaft 53, and an inner spring 552 provided on an inner side of the outer spring 551 so as to extend along the center shaft 53. The outer spring 551 and the inner spring 552 are arranged concentrically. Specifically, the inner spring 552 is arranged on a radially outer side of the center shaft 53, and the outer spring 551 is arranged on a radially outer side of the inner spring 552. In other words, the center shaft 53 is arranged on an inner side of the inner spring 552, and the inner spring 552 is arranged on an inner side of the outer spring 551. The inner spring 552 is arranged so as to be connected in parallel to the outer spring 551. Thus, the outer spring 551 and the inner spring 552 independently push the drive unit-side spring bearing portion 51 and the contact-side spring bearing portion 52 in the directions in which the drive unit-side spring bearing portion 51 and the contact-side spring bearing portion 52 are separated from each other.

The power transmission unit 5 further includes a pair of regulating portions 56, which are provided to both of the drive unit-side spring bearing portion 51 and the contact-side spring bearing portion 52, and are configured to regulate movement of the outer spring 551 in the radial direction. Thus, fluctuation of the force for pressing the movable contact 3 against the stationary contact 2 via the outer spring 551 is suppressed when the switchgear is closed.

The outer diameter of the center shaft 53 is equal to the inner diameter of the inner spring 552. Thus, the center shaft 53 regulates movement of the inner spring 552 in the radial direction. As a result, fluctuation of the force for pressing the movable contact 3 against the stationary contact 2 via the inner spring 552 is suppressed when the switchgear is closed.

Further, as represented by Expression (1) described in a non-patent literature ("Spring", edited by the Japan Society of Spring Research, Maruzen Co., Ltd., December 1982, P. 233), displacement δ of the spring in the radial direction becomes smaller as an outer diameter 2R of the spring becomes smaller.

[Math. 1]

$$\delta = \frac{64nR^3}{Ed^4}\left\{1 + \frac{1}{3}\left(\frac{H}{R}\right)^2\left(1 + \frac{E}{2G}\right)\right\} \tag{1}$$

In Expression (1), a wire diameter d of the spring and a number n of turns of the spring are determined depending on a limit value of a torsional stress, and hence only the outer diameter R of the spring is a variable.

Thus, the setting of the inner diameter of the inner spring 552 to be equal to the outer diameter of the center shaft 53 minimizes the fluctuation of the force for pressing the movable contact 3 against the stationary contact 2 via the inner spring 552 when the switchgear is closed.

The displacement of the outer spring 551 and the inner spring 552 in the radial direction is prevented so that the fluctuation of the force for pressing the movable contact 3 against the stationary contact 2 via the outer spring 551 and the inner spring 552 is reduced when the switchgear is closed. Thus, chattering is suppressed.

The displacement of the inner spring 552 in the radial direction is prevented by the center shaft 53, and hence the regulating portions 56 can be formed by bending, turning, bonding of circular plates, or other methods. As a result, the shapes of the drive unit-side spring bearing portion 51 and the contact-side spring bearing portion 52 can be simplified.

Compared to a spring member formed of a single spring, the spring member 55 can be downsized in the axial direction and the radial direction when the spring member 55 is formed of the outer spring 551 and the inner spring 552, that is, when the spring member 55 is formed to have two nested coils.

Figure 3:
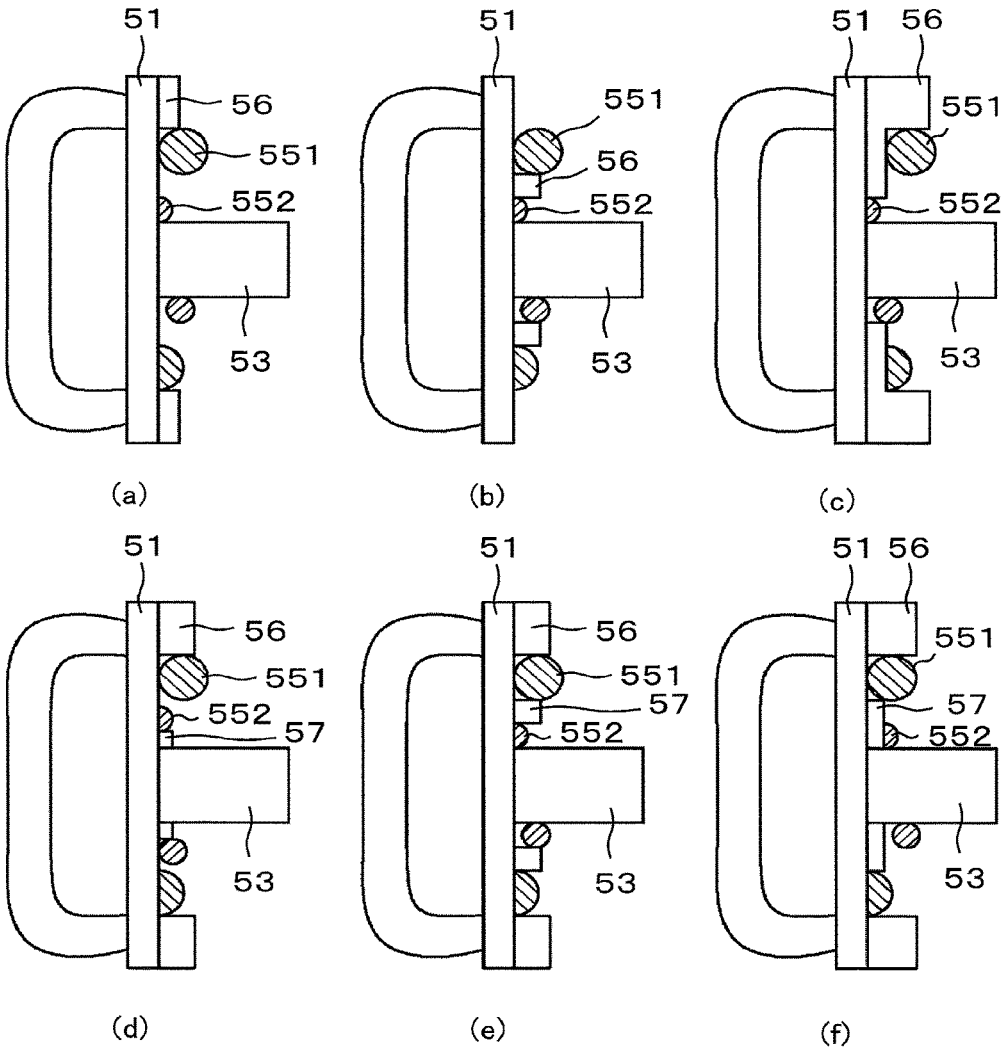
FIG. 3 is a view for illustrating modified examples of a regulating portion of FIG. 2.

Note that, in this example, description is made of the configuration in which each of the regulating portions 56 is arranged over the entire region in a circumferential direction of the center shaft 53 as illustrated in FIG. 2, but there may be employed a configuration in which a plurality of projecting portions are arranged side by side in the circumferential direction of the center shaft 53. Further, as illustrated in FIG. 3, there may be employed a configuration (a) in which the regulating portion 56 is brought into abutment against the outer spring 551 from the radially outer side to regulate the movement of the outer spring 551, a configuration (b) in which the regulating portion 56 is brought into abutment against the outer spring 551 from the radially inner side and against the inner spring 552 from the radially outer side to regulate the movement of the outer spring 551 and the inner spring 552, and a configuration (c) in which the regulating portion 56 is brought into abutment against both of the outer spring 551 and the inner spring 552 from the radially outer side to regulate the movement of the outer spring 551 and the inner spring 552. Still further, as illustrated in FIG. 3, there may be employed a configuration (d) in which the regulating portion 56 is brought into abutment against the outer spring 551 from the radially outer side and a regulating portion 57 is brought into abutment against the inner spring 552 from the radially inner side to regulate the movement of the outer spring 551 and the inner spring 552, a configuration (e) in which the regulating portion 56 is brought into abutment against the outer spring 551 from the radially outer side and the regulating portion 57 is brought into abutment against the outer spring 551 from the radially inner side and against the inner spring 552 from the radially outer side to regulate the movement of the outer spring 551 and the inner spring 552, and a configuration (f) in which the regulating portion 56 is brought into abutment against the outer spring 551 from the radially outer side and the regulating portion 57 is brought into abutment against the outer spring 551 from the radially inner side to regulate the movement of the outer spring 551. Note that, FIG. 3 is an illustration of the regulating portions each provided to the drive unit-side spring bearing portion 51, and the regulating portion provided to the contact-side spring bearing portion 52 is similar to the regulating portion provided to the drive unit-side spring bearing portion 51. Further, the regulating portion provided to the drive unit-side spring bearing portion 51 and the regulating portion provided to the contact-side spring bearing portion 52 may have different configurations.

Figure 4:
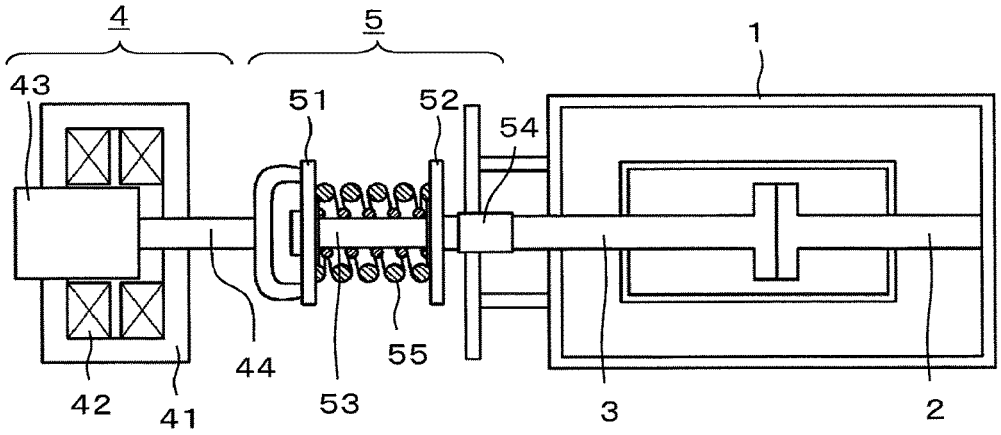
FIG. 4 is a sectional side view for illustrating a state in which the switchgear of FIG. 1 is closed.
Figure 5:
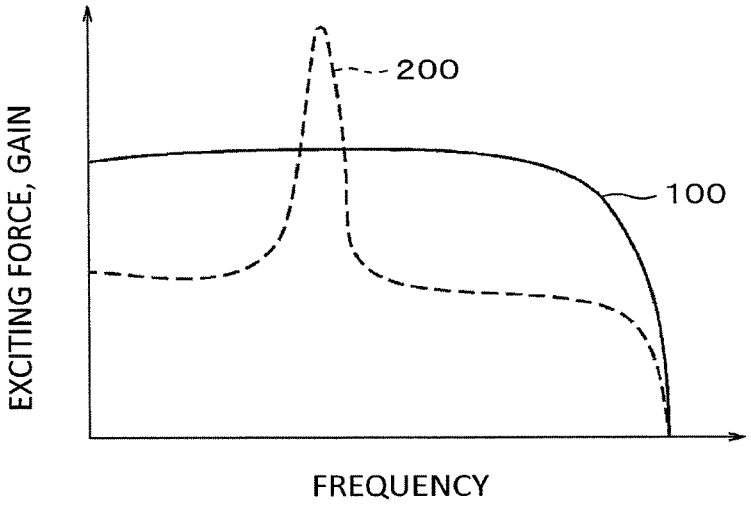
FIG. 5 is a graph for showing an exciting force generated in the switchgear and a natural frequency of the lowest order of a system.

FIG. 4 is a sectional side view for illustrating a state in which the switchgear of FIG. 1 is closed. When the state of the switchgear is changed from the opened state to the closed state (when the switchgear is switched on), the stationary contact 2 and the movable contact 3 collide with each other. A repulsive force generated due to the collision acts in a direction in which the stationary contact 2 and the movable contact 3 are spaced from each other so that the chattering is liable to occur. The repulsive force is an impulsive force, and hence a force in a wide frequency range is excited as represented by an exciting force 100 shown in FIG. 5. Now, considering the entire system in which the repulsive force is transmitted, the exciting force 100 is amplified at a natural frequency 200 of the lowest order of the system. As a result, at the natural frequency 200 of the lowest order of the system, the force acts in the direction in which the stationary contact 2 and the movable contact 3 are spaced from each other so that the chattering is liable to occur.

Figure 6:
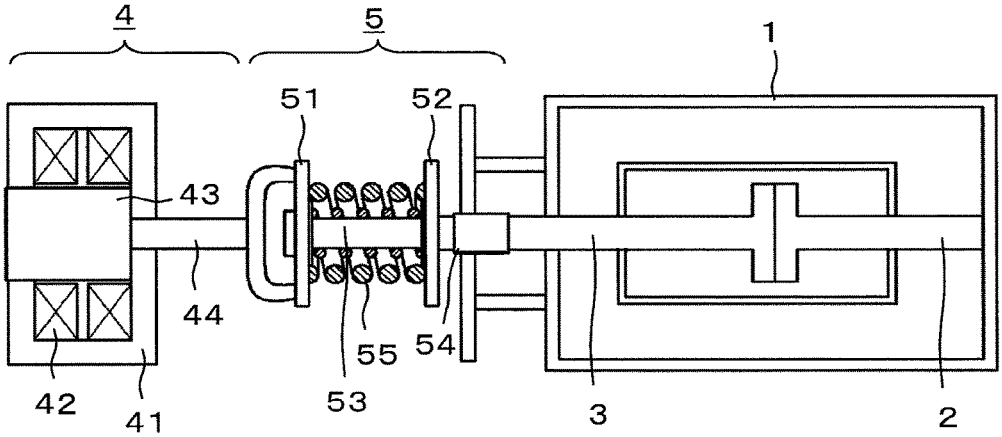
FIG. 6 is a sectional side view for illustrating the switchgear when a movable element of FIG. 4 collides with a case.

FIG. 6 is a sectional side view for illustrating the switchgear when the movable element 43 of FIG. 4 collides with the case 41. At a terminal end of the switch-on action, the movable element 43 collides with the case 41. The terminal end of the switch-on action refers to a state of the switched-on switchgear, namely a state in which the movable element 43 becomes closest to the stationary contact 2 after the movable element 43 starts to move in response to the start of current supply to the coil 42. Similarly to the case illustrated in FIG. 4, a repulsive force generated due to the collision between the movable element 43 and the case 41 also acts in the direction in which the stationary contact 2 and the movable contact 3 are spaced from each other so that the chattering is liable to occur. The repulsive force is an impulsive force, and hence a force in a wide frequency range is excited as represented by the exciting force 100 shown in FIG. 5. Now, considering the entire system in which the repulsive force is transmitted, the exciting force 100 is amplified at the natural frequency 200 of the lowest order of the system. As a result, at the natural frequency 200 of the lowest order of the system, the force acts in the direction in which the stationary contact 2 and the movable contact 3 are spaced from each other so that the chattering is liable to occur. In order to exclude natural frequencies that may be generated due to the stretch and torsion of metal members constructing the switchgear, the natural frequency 200 of the lowest order of the system is herein defined as such a frequency that the maximum gain is obtained at 1 kHz or less.

Figure 7:
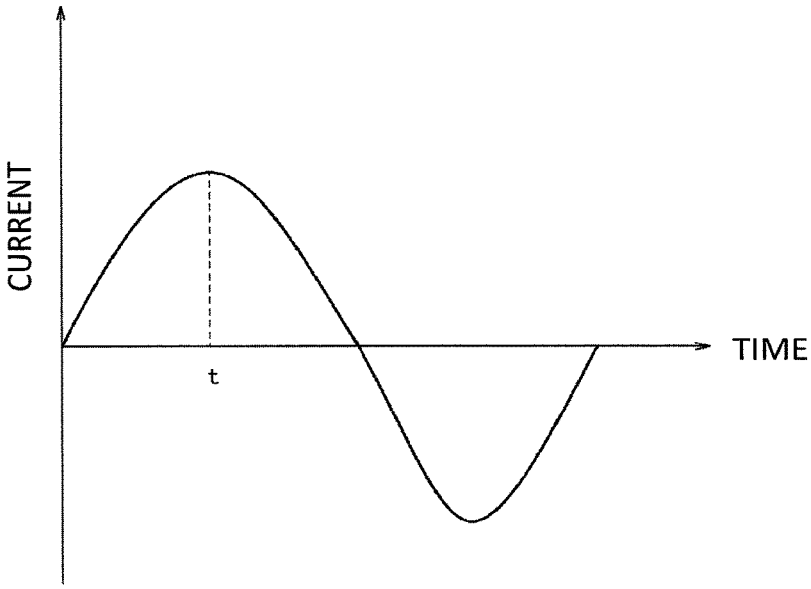
FIG. 7 is a graph for showing a relationship between a time and a current flowing through the switchgear of FIG. 1.

A current starts to flow between the stationary contact 2 and the movable contact 3 immediately after the switch-on action. Assuming that an initial phase is 0 and an AC frequency is from 50 Hz to 60 Hz, as shown in FIG. 7, chattering in the vicinity of a time t (from 4.2 ms to 5 ms) when the current becomes maximum significantly affects wear of the stationary contact 2 and the movable contact 3. In actuality, the phase is delayed, and hence the current becomes maximum at a delayed time t. For this reason, the chattering caused by an impact between the movable element 43 and the case 41 in the case of FIG. 6 tends to affect the wear of the stationary contact 2 and the movable contact 3 more significantly than the chattering caused by an impact between the movable contact 3 and the stationary contact 2 that occurs immediately after the switch-on action in the case of FIG. 4.

As the natural frequency 200 of the lowest order of the system, there are a plurality of candidates for the natural frequency, such as the bend, stretch, and torsion of the metal members, and the bend, torsion, and surging of the spring member 55. In general, the frequencies of the stretch and torsion of the metal members are as high as several kilohertz, and hence those frequencies may be excluded from the natural frequency 200 of the lowest order of the system. In contrast, the frequency of the bend of the metal members and the natural frequency of the spring member 55 are relatively low, and hence those frequencies are included in the candidates for the natural frequency 200 of the lowest order. Further, the housing 1 made of a resin has lower rigidity than the metal members, and hence the frequency of the housing 1 is included in the candidates for the natural frequency 200 of the lowest order of the system.

Figure 8:
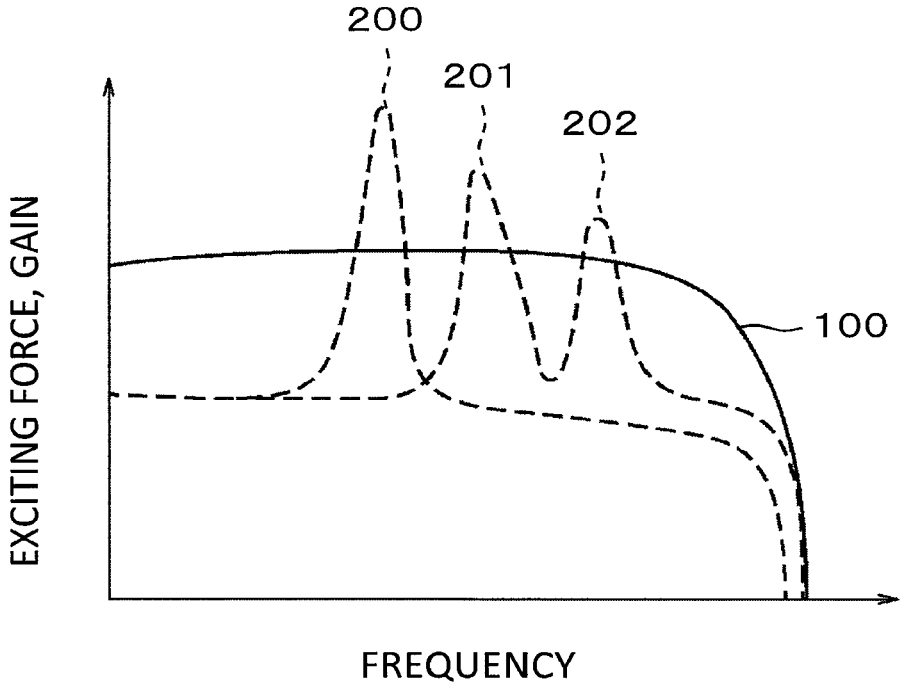
FIG. 8 is a graph for showing the exciting force generated in the switchgear, the natural frequency of the lowest order of the system, and increased natural frequencies of the lowest order of the system.

In the case of the spring member 55 formed to have two nested coils, the load is distributed as compared to a spring member (not shown) formed to have a single coil with the same spring constant as that of the spring member 55, and hence the mass of each spring is reduced, thereby being capable of increasing the frequency of the surging of the spring member 55. Thus, when the natural frequency 200 of the lowest order of the system is the natural frequency of the spring member 55, the natural frequency 200 of the lowest order of the system can be increased by forming the spring member 55 to have two nested coils. As a result, as shown in FIG. 8, increased natural frequencies 201 and 202 of the lowest order of the system can be obtained. When the natural frequency of the spring member 55 can be increased greatly, this natural frequency becomes higher than any other natural frequency in the system, thereby enabling the natural frequencies 201 and 202 of the spring member 55 to be excluded from the natural frequency 200 of the lowest order of the system.

In general, as the natural frequency becomes higher, the exciting force itself becomes smaller, thereby enhancing the damping effect. As a result, vibration is less liable to occur. In the switchgear, the chattering can be suppressed by increasing the natural frequency 200 of the lowest order of the system.

Further, when the spring member 55 is formed to have two nested coils, downsizing can be achieved as compared to the spring member formed to have a single coil, with the result that the natural frequencies of the bend and torsion are also increased. Thus, the chattering can be suppressed similarly.

As described above, according to the switchgear of the first embodiment of the present invention, the spring member 55 includes the outer spring 551 and the inner spring 552 provided on the inner side of the outer spring 551 and arranged so as to be connected in parallel to the outer spring 551. Therefore, it is possible to increase the natural frequency 200 of the lowest order in a range of from the electromagnetic actuator 4 to the movable contact 3. Thus, the effect on the movable contact 3 from the exciting force generated due to the impact is reduced, thereby being capable of suppressing the separation of the movable contact 3 and the stationary contact 2. As a result, the chattering can be suppressed more greatly.

Further, the power transmission unit 5 includes the center shaft 53, which is fixed to the contact-side spring bearing portion 52 and provided on the inner side of the inner spring 552, and has the outer diameter equal to the inner diameter of the inner spring 552, and the regulating portions 56, which are provided to the drive unit-side spring bearing portion 51 and the contact-side spring bearing portion 52, and are configured to regulate the movement of the outer spring 551 in the radial direction. Therefore, the movement of the outer spring 551 and the inner spring 552 in the radial direction is prevented so that the fluctuation of the force for pressing the movable contact 3 against the stationary contact 2 via the outer spring 551 and the inner spring 552 can be reduced when the switchgear is closed. Thus, the chattering can be suppressed. Further, the shapes of the drive unit-side spring bearing portion 51 and the contact-side spring bearing portion 52 can be simplified.

Note that, in the first embodiment described above, description is made of the configuration in which the spring member 55 is formed to have two nested coils so as to increase the natural frequency of the spring member 55, but a surgeless spring capable of suppressing the surging may be used as the spring member 55. The surgeless spring may be realized by setting an irregular pitch or inserting a member for restricting a shift between the turns of the spring. Further, there may be employed a configuration in which the spring member 55 is formed to have three or more nested coils. The surgeless spring herein refers to a spring capable of suppressing the surging or a spring having a surgeless function, which is generally called surgeless coil spring.

Second Embodiment

At the terminal end of the switch-on action illustrated in FIG. 6, the movable element 43 collides with the case 41 to generate an impact. Therefore, when the generation of the impact or transmission of the impact to the movable contact 3 can be suppressed, the chattering can be suppressed. As a method for suppressing the generation of the impact or the transmission of the impact to the movable contact 3, there are conceived two patterns, namely a case of eliminating a cause of the impact and a case of interrupting a transmission path of the impact.

Figure 9:
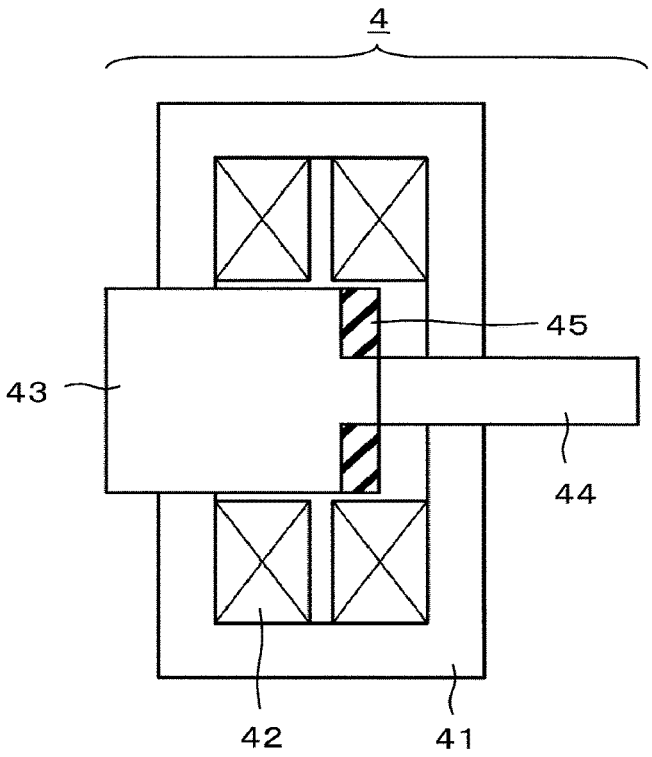
FIG. 9 is a sectional side view for illustrating a main part of a switchgear according to a second embodiment of the present invention.

FIG. 9 is a sectional side view for illustrating a main part of a switchgear according to a second embodiment of the present invention. FIG. 9 is an illustration of the switchgear in the case of eliminating the cause of the impact. The electromagnetic actuator 4 further includes an impact-generation suppressing portion 45 provided to the movable element 43. The impact-generation suppressing portion 45 is arranged so as to be sandwiched between the movable element 43 and the case 41 when the movable contact 3 (FIG. 6) is located at the closed position. Thus, the impact-generation suppressing portion 45 suppresses the generation of the impact between the movable element 43 and the case 41 when the movable contact 3 is shifted from the opened position to the closed position.

As a method for manufacturing the impact-generation suppressing portion 45, there is given a method of forming the impact-generation suppressing portion 45 on the movable element 43 by roughening the shape of the surface of the movable element 43 that is opposed to the collision surface of the case 41, a method of forming the impact-generation suppressing portion 45 on the movable element 43 by forming the movable element 43 so that the movable element 43 is partially brought into contact with the case 41, a method of forming the impact-generation suppressing portion 45 on the movable element 43 by forming a laminate at a part of the movable element 43 that is opposed to the collision surface of the case 41, or a method of arranging a member having a high damping effect, such as a rubber, at a part of the movable element 43 that is opposed to the collision surface of the case 41. Note that, in order to maintain the relationship that the magnetic attraction force F1 generated by the electromagnetic actuator 4 is larger than the repulsive force F2 generated by the spring member (magnetic attraction force F1>repulsive force F2) when the switchgear is closed, and to prevent failure in the switch-on action, the impact-generation suppressing portion 45 is formed to have such a thickness or shape that the rigidity is kept high and the magnetic attraction force F1 is not decreased. Note that, in FIG. 9, description is made of the configuration in which the impact-generation suppressing portion 45 is provided to the movable element 43, but there may be employed a configuration in which the impact-generation suppressing portion 45 is also provided to the case 41. Further, there may be employed a configuration in which the impact-generation suppressing portion 45 is provided to any one of the movable element 43 and the case 41.

Figure 10:
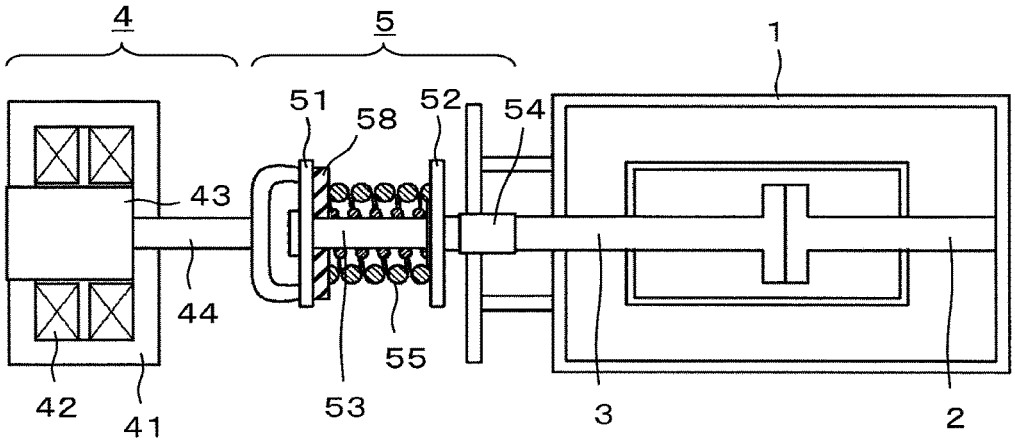
FIG. 10 is a sectional side view for illustrating the switchgear including an electromagnetic actuator of FIG. 9.

FIG. 10 is a sectional side view for illustrating the switchgear including the electromagnetic actuator 4 of FIG. 9. FIG. 10 is an illustration of the switchgear in the case of interrupting the transmission path of the impact. The power transmission unit 5 further includes an impact-transmission suppressing portion 58 provided to the drive unit-side spring bearing portion 51 so as to be sandwiched between the drive unit-side spring bearing portion 51 and the spring member 55.

As a method for manufacturing the impact-transmission suppressing portion 58, there is given a method of mounting a rubber having a high damping effect, a laminated member, a hydraulic damper, or other components on the drive unit-side spring bearing portion 51.

Note that, in this example, description is made of the configuration in which the impact-transmission suppressing portion 58 is provided between the drive unit-side spring bearing portion 51 and the spring member 55, but it is only necessary to employ a configuration in which the impact-transmission suppressing portion 58 is provided between the movable element 43 and the movable contact 3. Thus, the transmission of the impact generated between the movable element 43 and the case 41 to the movable contact 3 is suppressed when the movable contact 3 is shifted from the opened position to the closed position. Further, the switchgear may have a configuration including both of the impact-generation suppressing portion 45 and the impact-transmission suppressing portion 58.

As described above, according to the switchgear of the second embodiment of the present invention, the electromagnetic actuator 4 further includes the impact-generation suppressing portion 45, which is provided between the case 41 and the movable element 43, and is configured to suppress the generation of the impact between the case 41 and the movable element 43 when the movable contact 3 is shifted from the opened position to the closed position. Therefore, the transmission of the impact generated at the terminal end of the electromagnetic actuator 4 to the movable contact 3 is suppressed. Thus, the effect on the movable contact 3 from the exciting force generated due to the impact is reduced, thereby being capable of suppressing the separation of the movable contact 3 and the stationary contact 2. As a result, the chattering can be suppressed more greatly.

Further, the power transmission unit 5 further includes the impact-transmission suppressing portion 58, which is provided between the movable element 43 and the movable contact 3, and is configured to suppress the transmission of the impact generated between the case 41 and the movable element 43 to the movable contact 3 when the movable contact 3 is shifted from the opened position to the closed position. Therefore, the transmission of the impact generated at the terminal end of the electromagnetic actuator 4 to the movable contact 3 is suppressed. Thus, the effect on the movable contact 3 from the exciting force generated due to the impact is reduced, thereby being capable of suppressing the separation of the movable contact 3 and the stationary contact 2. As a result, the chattering can be suppressed more greatly.

After subtraction of the repulsive force F2 generated by the power transmission unit 5 from the magnetic attraction force F1 generated by the electromagnetic actuator 4, the resultant magnetic attraction force F1 entirely acts as a pressure F1-F2 to be applied between the stationary contact 2 and the movable contact 3.

The pushed state illustrated in FIG. 6 is a normal energization state. When a high current flows, an electromagnetic repulsive force F3 acts. When F1-F2<F3, the contacts are spaced from each other so that the switchgear is opened. As a result, the current is interrupted. If the repulsive force F2 is extremely large, the switchgear is opened highly frequently, thereby degrading practicability. If the repulsive force F2 is extremely small, on the other hand, even when an overcurrent flows, the current is not easily interrupted, thereby degrading reliability. Also if a part of the magnetic attraction force F1 generated by the electromagnetic actuator 4 is transmitted to and consumed by a portion other than the power transmission unit 5, the switchgear is opened highly frequently, thereby degrading the practicability. Therefore, it is necessary that the magnetic attraction force F1 generated by the electromagnetic actuator 4 be entirely transmitted to the portion between the stationary contact 2 and the movable contact 3 via the power transmission unit 5.

In this case, the drive unit-side spring bearing portion 51 and the contact-side spring bearing portion 52 sandwich the inner spring 552 and the outer spring 551. When the opened state illustrated in FIG. 1 is shifted to the pushed state illustrated in FIG. 6 in which the movable element 43 collides with the case 41, the inner spring 552 and the outer spring 551 are extended or contracted by the same shift amount, and hence the magnetic attraction force F1 generated by the electromagnetic actuator 4 is transmitted to the power transmission unit 5 and to the portion between the stationary contact 2 and the movable contact 3 without loss.

In order to increase the frequencies of the surging of the inner spring 552 and the outer spring 551 on average, optimal shapes of the inner spring 552 and the outer spring 551 are set so as to have the same wire diameter and the same outer diameter of the spring. In this configuration, however, the inner spring 552 and the outer spring 551 interfere with each other, and cannot therefore be arranged concentrically. If the inner spring 552 and the outer spring 551 are arranged in a parallel state but not arranged concentrically, a force acts in a bending direction on the movable contact 3 or the electromagnetic actuator 4 due to non-uniformity of the load, resulting in an unstable operation. Therefore, the outer diameter of the inner spring 552 needs to be set smaller than the inner diameter of the outer spring 551. When the outer diameter of the inner spring 552 is set smaller under a state in which the wire diameter remains unchanged, however, a modified stress of the spring becomes a problem, which degrades the reliability of the spring. Therefore, the wire diameter of the inner spring 552 is set smaller than the wire diameter of the outer spring 551. The spring having a small wire diameter and a small inner diameter is also small in repulsive force, and hence the repulsive force of the outer spring 551 becomes larger than the repulsive force of the inner spring 552. Further, the spring having a small wire diameter and a small inner diameter is also small in mass of the spring, and hence the frequency of the surging is increased. Thus, the increased natural frequency 201 of the lowest order of the system is generated by the outer spring 551.

Figure 11:
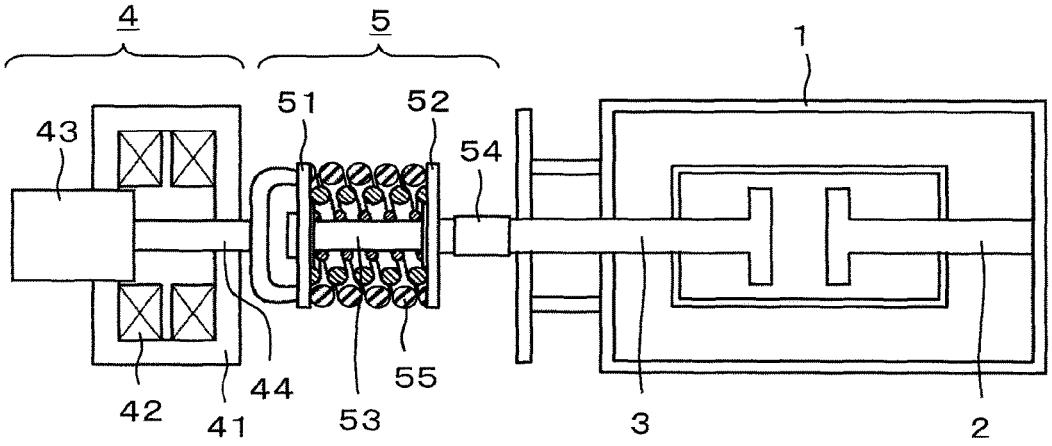
FIG. 11 is a sectional side view for illustrating a switchgear when a spring member of FIG. 1 is formed to have three nested coils.
Figure 12:
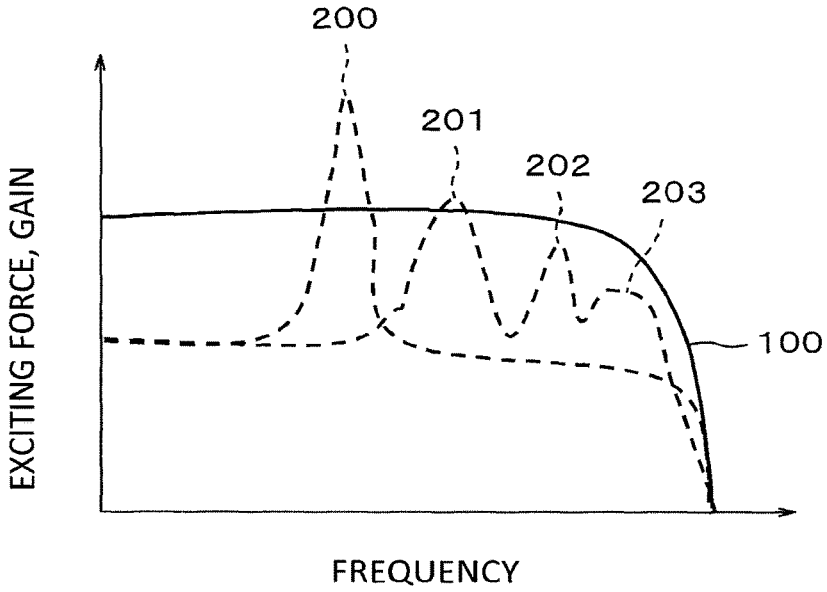
FIG. 12 is a graph for showing an exciting force generated in the switchgear of FIG. 11, a natural frequency of the lowest order of a system, and increased natural frequencies of the lowest order of the system.

FIG. 11 is a sectional side view for illustrating a switchgear when the spring member 55 of FIG. 1 is formed to have three nested coils. FIG. 12 is a graph for showing an exciting force generated in the switchgear of FIG. 11, a natural frequency of the lowest order of a system, and increased natural frequencies of the lowest order of the system. The outer spring 551 is formed to have two nested coils to attain the three nested coils of the spring member 55. When the spring member 55 is formed to have three nested coils as illustrated in FIG. 11, the natural frequency 200 of the lowest order of the system can be increased to attain increased natural frequencies 201, 202, and 203 of the lowest order of the system. With the increased natural frequencies 201, 202, and 203 of the lowest order of the system, the natural frequency of the spring member 55 can be kept higher and the gain can be kept at a lower valve than in the case of the natural frequencies 201 and 202 of the lowest order of the system, which are shown in FIG. 8. Similar effects can be attained also when the spring member 55 is formed to have four or more nested coils, but in a high frequency range, the exciting force itself becomes smaller, and hence those effects are not easily attained.

The invention claimed is:

1. A switchgear, comprising:

a stationary contact;

a movable contact, which is configured to be shifted between a closed position where the movable contact is brought into contact with the stationary contact and an opened position where the movable contact is separated from the stationary contact;

a drive unit, which is configured to generate power for shifting the movable contact, the drive unit comprising:

a stator; and a movable element, which is configured to be shifted relative to the stator; and a power transmission unit, which is configured to shift the movable contact through transmission of the power generated by the drive unit, and to press the movable contact against the stationary contact when the movable contact is located at the closed position, the power transmission unit comprising:

a drive unit-side spring bearing portion, which is configured to be shifted together with the movable element;

a contact-side spring bearing portion, which is provided so as to be opposed to the drive unit-side spring bearing portion, and is configured to be shifted together with the movable contact; and a spring member, which is provided between the drive unit-side spring bearing portion and the contact-side spring bearing portion, and is configured to push the drive unit-side spring bearing portion and the contact-side spring bearing portion in directions in which the drive unit-side spring bearing portion and the contact-side spring bearing portion are separated from each other, the spring member comprising:

a radially outer spring; and a radially inner spring, which is provided on a radially inner side of the radially outer spring, connected in parallel to the radially outer spring, and is arranged so as to be contracted by the same amount as the radially outer spring during a period in which the movable contact is shifted from a state of being located at the opened position to a state of being located at a terminal end of switch-on action, wherein a repulsive force of the radially outer spring is set to be larger than a repulsive force of the radially inner spring.

2. A switchgear according to claim 1, wherein the power transmission unit further comprises a center shaft, which is fixed to the contact-side spring bearing portion and provided on an inner side of the radially inner spring, and has an outer diameter equal to an inner diameter of the radially inner spring.

3. A switchgear according to claim 1, wherein a natural frequency of the radially outer spring is set as a natural frequency of a lowest order of a system.

4. A switchgear according to claim 1, wherein the drive unit further comprises an impact-generation suppressing portion, which is provided between the stator and the movable element, and is configured to suppress generation of an impact between the stator and the movable element when the movable contact is shifted from the opened position to the closed position.

5. A switchgear according to claim 1, wherein the power transmission unit further comprises an impact-transmission suppressing portion, which is provided between the movable element and the movable contact, and is configured to suppress transmission of the impact generated between the stator and the movable element to the movable contact when the movable contact is shifted from the opened position to the closed position.

6. A switchgear according to claim 1, wherein the power transmission unit further comprises a regulating portion which is provided to at least one of the drive unit-side spring bearing portion or the contact-side spring bearing portion and is configured to regulate movement of the radially outer spring in a radial inward direction of the radially outer spring, which radially inward direction is a direction toward the radially inner spring.

7. A switchgear comprising:

a stationary contact;

a movable contact which is configured to be shifted between a closed position where the movable contact is brought into contact with the stationary contact and an opened position where the movable contact is separated from the stationary contact;

a drive unit which is configured to generate power for shifting the movable contact, the drive unit comprising:

a stator; and a movable element which is configured to be shifted relative to the stator; and a power transmission unit which is configured to shift the movable contact through transmission of the power generated by the drive unit and to press the movable contact against the stationary contact when the movable contact is located at the closed position, the power transmission unit comprising:

a drive unit-side spring bearing portion which is configured to be shifted together with the movable element;

a contact-side spring bearing portion which is provided so as to be opposed to the drive unit-side spring bearing portion and is configured to be shifted together with the movable contact; and a spring member which is provided between the drive unit-side spring bearing portion and the contact-side spring bearing portion and is configured to push the drive unit-side spring bearing portion and the contact-side spring bearing portion in directions in which the drive unit-side spring bearing portion and the contact-side spring bearing portion are separated from each other, the spring member comprising:

a radially outer spring; and a radially inner spring which is provided on a radially inner side of the radially outer spring, connected in parallel to the radially outer spring, and is arranged so as to be contracted by the same amount as the radially outer spring during a period in which the movable contact is shifted from a state of being located at the opened position to a state of being located at a terminal end of switch-on action, wherein a natural frequency of the radially outer spring is set as a natural frequency of a lowest order of a system.

* * * * *